United States Patent [19]

Blink et al.

[11] 4,262,381

[45] Apr. 21, 1981

[54] AMPHIBIOUS VEHICLE BRIDGE APPARATUS

[76] Inventors: James A. Blink, 45211 Crown Ave., King City, Calif. 93930; Alvin E. Nieder, 4910 Turquoise Cir., Colorado Springs, Colo. 80917

[21] Appl. No.: 90,809

[22] Filed: Nov. 2, 1979

[51] Int. Cl.[3] ..... E01D 15/14

[52] U.S. Cl. ..... 14/2.6; 14/27

[58] Field of Search ..... 14/1, 2.4, 2.6; 114/263; 405/218, 219, 220

[56] References Cited

U.S. PATENT DOCUMENTS

| | | | |
|---|---|---|---|
| 2,321,677 | 6/1943 | Higgins | 14/2.4 |
| 3,010,128 | 5/1956 | Gillois | 14/2.4 |
| 3,021,544 | 3/1956 | Gillois | 14/2.4 |
| 3,068,830 | 9/1956 | Dickerson | 14/2.4 |
| 3,152,569 | 10/1944 | Gehlen | 14/2.6 |
| 3,208,086 | 9/1946 | Gillois | 14/2.4 X |
| 3,597,784 | 7/1945 | Gehlen | 14/2.4 X |
| 3,837,027 | 3/1947 | Gehlen | 14/2.4 X |
| 3,871,045 | 4/1946 | Bouvet | 14/2.4 |

FOREIGN PATENT DOCUMENTS

| | | | |
|---|---|---|---|
| 1409051 | 12/1956 | Fed. Rep. of Germany | 14/27 |

*Primary Examiner*—Nile C. Byers, Jr.
*Attorney, Agent, or Firm*—Darrell E. Hollis

[57] ABSTRACT

An amphibious vehicle is disclosed including at least one outrigger pontoon member connected with the vehicle body for pivotal movement about a horizontal longitudinal pivot axis between retracted and laterally extended positions relative to the vehicle body. The pivot axis is adjacent the bottom portion of the vehicle body, seal means being provided for sealing the space between the vehicle body and the pontoon member.

8 Claims, 14 Drawing Figures

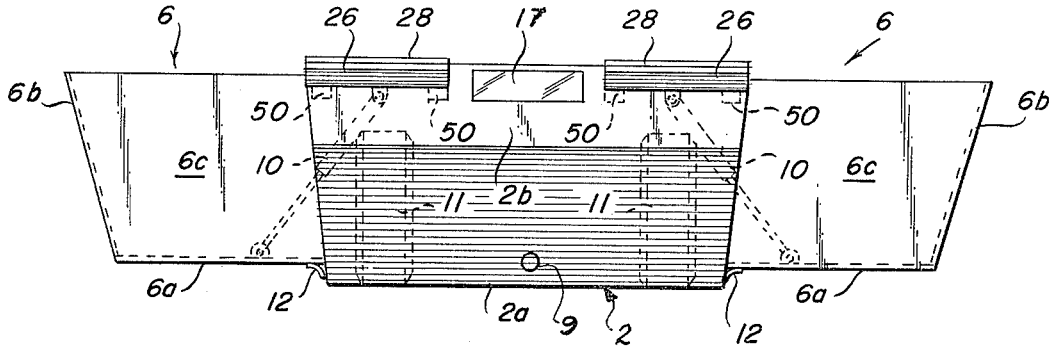
Fig. 1
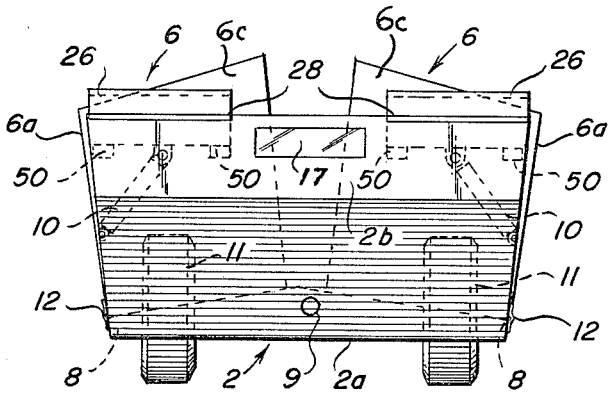
Fig. 2
Fig. 5
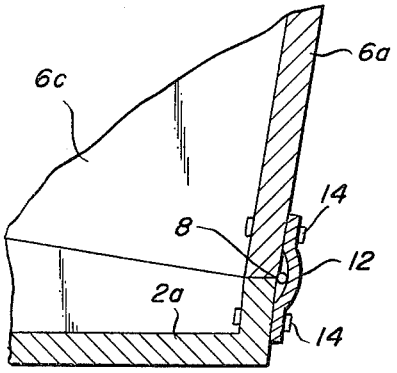
Fig. 6
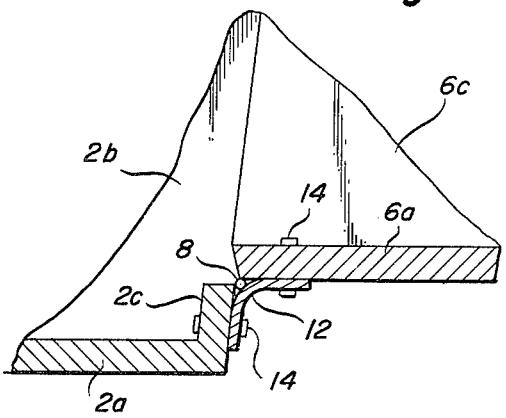

Fig. 3
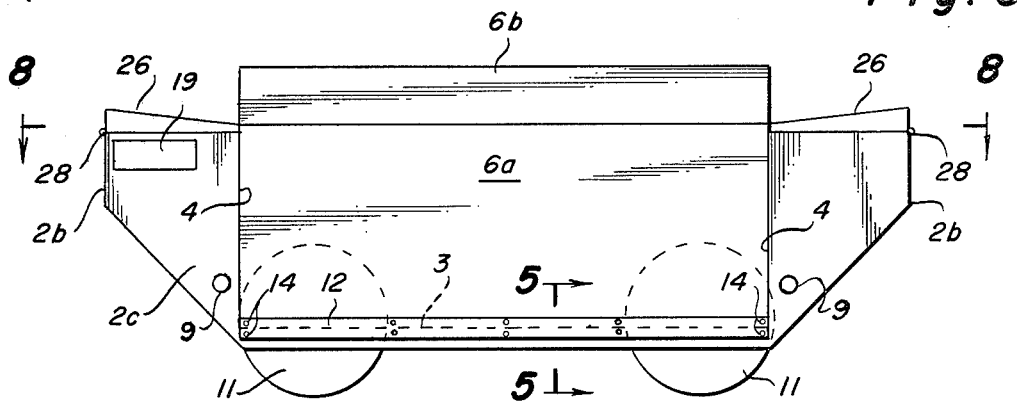
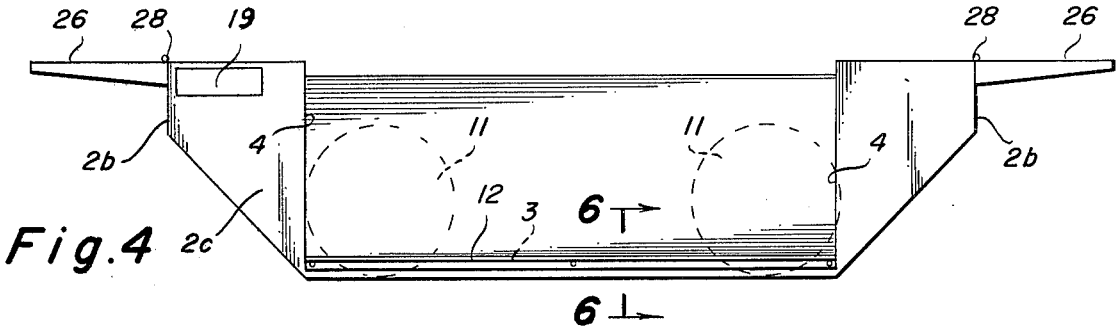
Fig.4
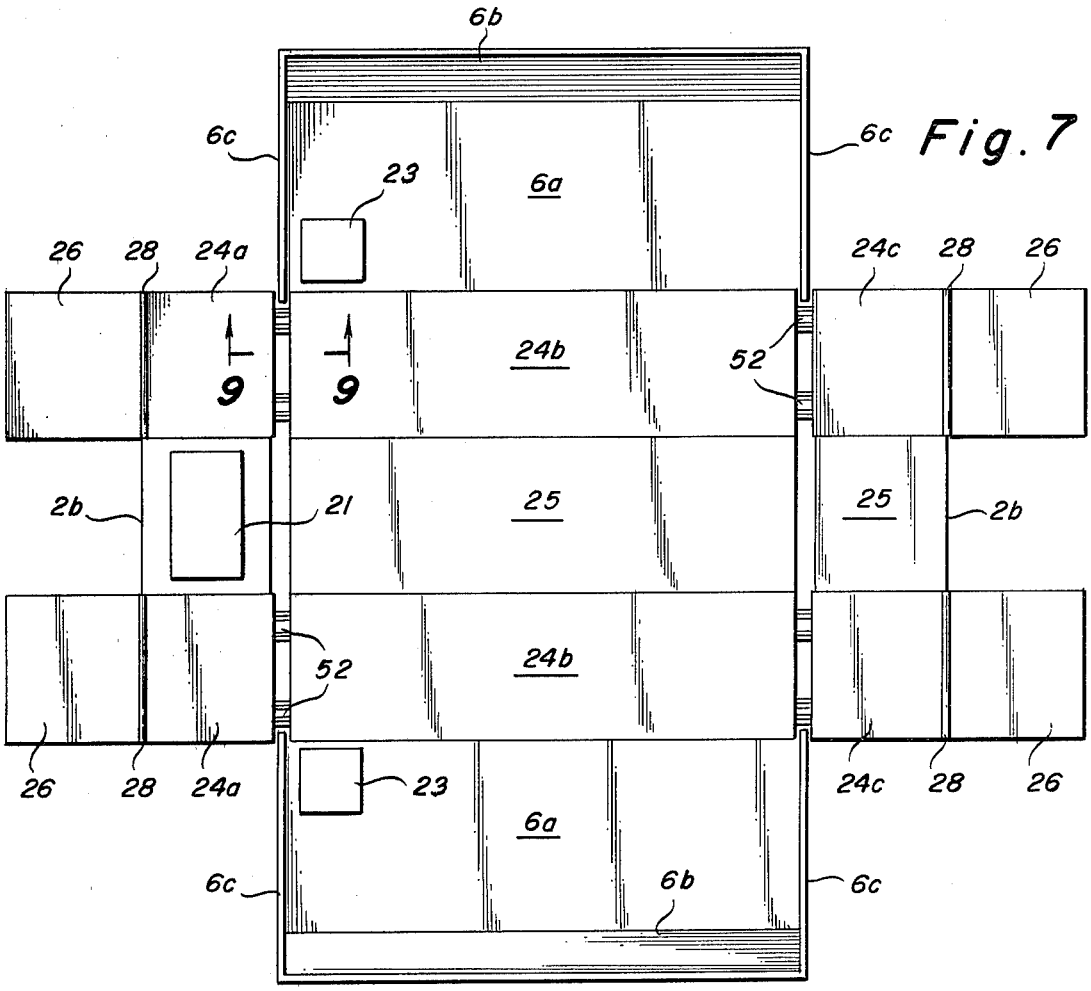
Fig. 7

Fig. 8
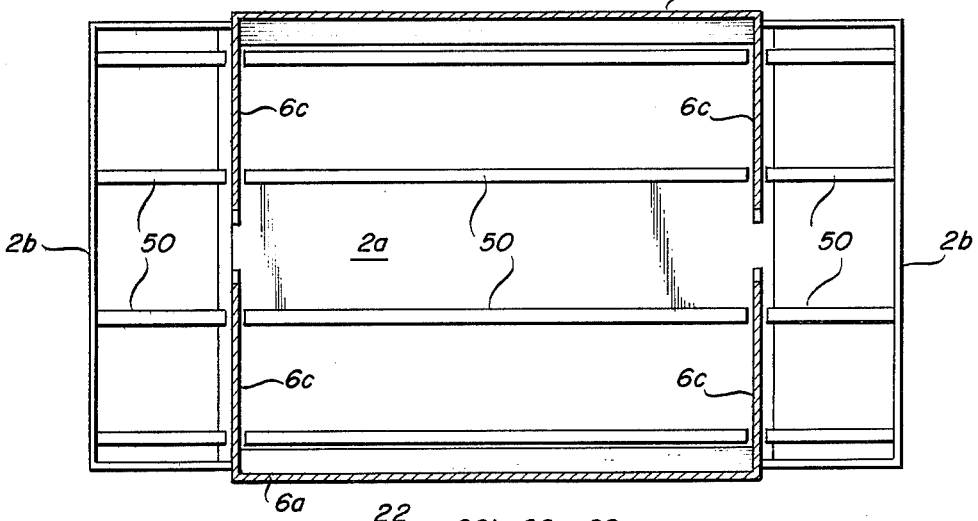
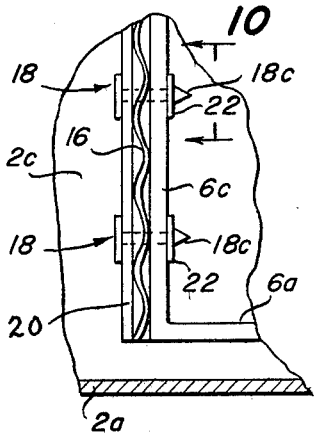
Fig. 9
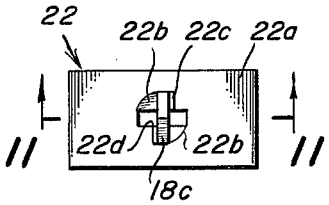
Fig. 10
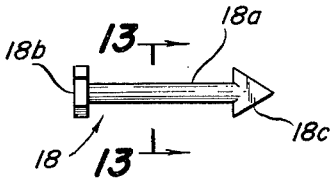
Fig. 12
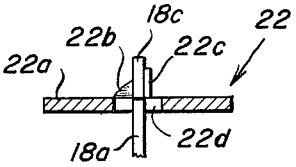
Fig. 11
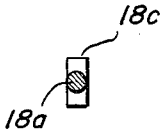
Fig. 13
Fig. 14
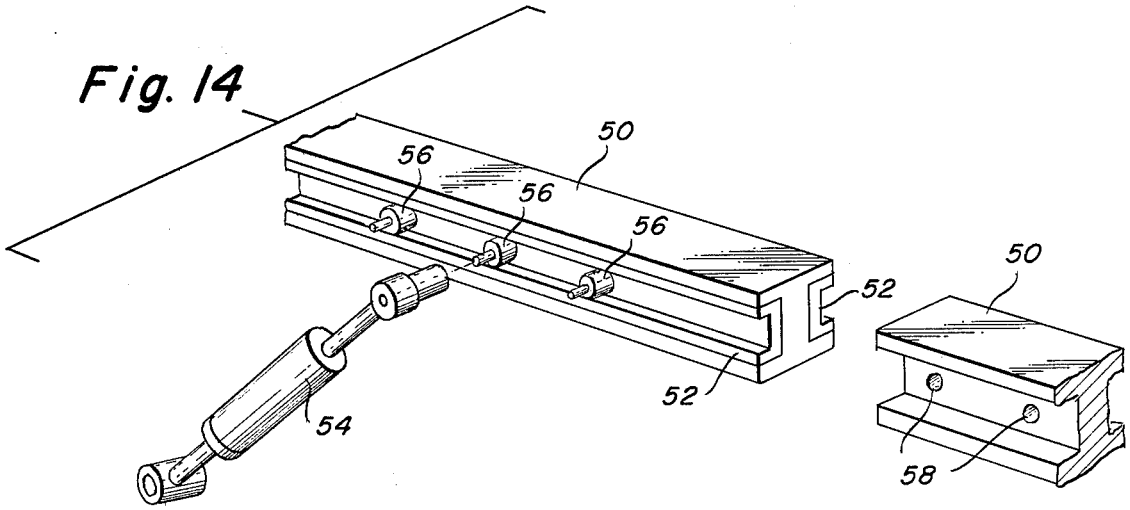

AMPHIBIOUS VEHICLE BRIDGE APPARATUS

BACKGROUND OF THE INVENTION

1. Field of the Invention

The present invention relates to an amphibious vehicle which is used either alone or in combination with a plurality of other vehicles to form a floating bridge.

2. Description of the Prior Art

Amphibious vehicles which form a floating bridge are known in the prior art as evidenced, for example, by the patent to Gehlen et al U.S. Pat. No. 3,152,569, which discloses an amphibious vehicle including a floating main body, and a pair of auxiliary floats which are pivotally connected with the main body for movement between an upper storage position in which the floats rest on the deck, and a lower position in which the floats extend laterally from the main body. The known amphibious bridge devices have shortcomings in that the bridge sections and floats are usually stored on the deck of the vehicle during transport, thereby causing the vehicle to be bulky and unstable.

SUMMARY OF THE INVENTION

Accordingly, a primary object of the present invention is to provide an amphibious vehicle in which the pontoon sections are stored substantially within the vehicle body member thereby causing the vehicle to be compact and maneuverable during transport.

The vehicle includes a vehicle body member, a longitudinal upper deck, longitudinally extendable front and rear ramps, and laterally extendable opentop outrigger pontoons on both sides. The outrigger pontoons are pivotable about a longitudinal extending horizontal pivot axis between a retracted transport position in which a major portion of the pontoon is contained within the vehicle body, and a laterally extended position in which the pontoons are positioned substantially externally of the vehicle body member. When the pontoons are in the extended position, the vehicle can displace more water and therefore will have an increased load carrying capacity. The extended pontoons also provide lateral stability when the amphibious vehicle is in the water. By pivoting the pontoons about an axis slightly above the bottom of the vehicle body, any leakage water collected in the bottom may be easily pumped out. The vertical joints between the outrigger pontoon and the vehicle body sidewalls are sealed by a compressible seal which is held in compression between the side wall and the pontoon by locking pins which tighten by rotation on a camway.

It is therefore another object of the invention to provide an amphibious vehicle which has an increased load supporting capacity in water relative to its land transport size.

It is another object of the invention to provide improved seal means for sealing the joints between the outrigger pontoons and the vehicle body.

It is still another object of the invention to provide an amphibious vehicle which possesses excellent structural strength in the bridge forming water condition.

BRIEF DESCRIPTION OF THE DRAWING

Other objects and advantages of the invention will become apparent from a study of the following specification when viewed in light of the accompanying drawing, in which:

FIG. 1 is a front view of the amphibious vehicle with the pontoons in the laterally-extended bridge-forming condition;

FIG. 2 is a front view of the vehicle with the pontoons in the retracted transport condition;

FIG. 3 is a side elevational view of the apparatus of FIG. 2;

FIG. 4 is a side elevational view of the apparatus of FIG. 1;

FIG. 5 is a detailed cross-sectional view taken along line 5—5 of FIG. 3;

FIG. 6 is a detailed cross-sectional view taken along line 6—6 of FIG. 4;

FIG. 7 is a top view of FIG. 4;

FIG. 8 is a cross-sectional view taken along line 8—8 of FIG. 3, with the deck sections removed;

FIG. 9 is a detailed cross-sectional view of the vertical sealing means taken along line 9—9 of FIG. 7;

FIG. 10 is a detailed view of the cam plate taken along line 10—10 of FIG. 9;

FIG. 11 is a cross-sectional view taken along line 11—11 of FIG. 10;

FIG. 12 is a detailed side view of the locking pin;

FIG. 13 is a cross-sectional view of the locking pin taken along line 13—13 of FIG. 12; and FIG. 14 is a detailed view of the slidable stringer.

DETAILED DESCRIPTION

Referring first to FIGS. 1 and 2, the amphibious vehicle includes a vehicle body member 2 having a horizontal bottom wall **2*a*, a pair of generally vertical front and rear end walls 2*b*, and a pair of generally vertical side walls 2*c*. As shown in FIGS. 3 and 4, side walls 2*c* contain an opening defined by a generally horizontal bottom edge 3 and a pair of vertical edges 4. A pair of outrigger pontoons 6 are pivotally connected with the bottom edge 3 of the opening by a longitudinally extending hinge 8, said pontoons being movable between an initial laterally extended condition (as shown in FIGS. 1 and 4), and a retracted transport condition (illustrated in FIGS. 2 and 3). As shown in FIG. 1, the pontoons, when in the laterally extended position, include a generally rectangular bottom portion 6*a* which is pivotally connected with the side wall 2*c* by hinge 8, a side portion 6*b*, and a pair of front and rear end portions 6*c*. Hydraulic cylinders 10 are provided for pivoting the pontoon between the extended and retracted positions. The vehicle body member 2 is provided with a plurality of wheels 11 which are retracted into the vehicle body member during nautical use. Propulsion in the water may be provided by conventional means such as propellars or water jets, strategically located as indicated for example at ports 9—9 in FIGS. 1, 2 and 3**.

As shown in FIGS. 5 and 6, a rubber sealing strip 12 is secured to the body member sidewall **2*c* and the pontoon bottom portion 6*a* by a plurality of fasteners 14. Water pressure compresses the seal against the hinge 8 and seals the joint between the sidewall 2*c* and the bottom portion 6*a***, thereby preventing water from entering the vehicle body member.

As shown in FIG. 9, a compressible sealing strip 16 is located between the body member sidewall **2*c* and the pontoon end portion 6*c*. The pins 18 pass through a vertical flange 20 on the sidewall 2*c*, the sealing strip 16, the end portion 6*c*, and a cam plate 22, respectively. The cam plate is secured to the inner surface of the end portion 6*c*. The pins 18 include a tubular shaft portion 18*a*, a hexagonal head portion 18*b*, and a triangular shaped locking portion 18c. The cam plate 22 includes a base portion 22a, a pair of inclined camway surfaces 22b, a pair of rotation stops 22c and an opening 22d. In operation, the locking portion 18c of the locking pin 18 is inserted through a hole in the verticle flange 20, through the opening 22d in the base plate, and rotated through an angle of about 90° as indicated in FIG. 10. Rotation of the locking portion 18c on the camway surfaces 22b causes the body member vertical flange portion 20, and the pontoon end portion 6c** to move toward each other thereby compressing the sealing strip and effecting a waterproof seal.

Observation windows 17 and 19 are provided to allow viewing from the main control cabin hatch 21. Auxiliary control positions 23 are located in each of the pontoons 6.

The upper surface of the body member is provided with deck sections 24a, 24b, and 24c which support heavy traffic loads during use. The deck is preferably made from a dimpled sheathing material, such as U.S. Army Expedient Runway Surface "Mo-Mat" which may be provided with a gritty upper surface for better wear and traction. Filler panels 25 provide footways and support light narrow traffic loads. Ramps 26 pivot about hinges 28 to increase the overall length of the amphibious vehicle.

The deck sections are supported by a plurality of longitudinally arranged support stringers 50 which are provided with slots through which the pontoon end walls 6c pass in the retracted transport position. The support stringers 50 are provided with slidable inner stringers 52, FIG. 14, which are slid across the gap by a hydraulic cylinder 54. After the slidable inner stringer is across the gap, a plurality of anchors 56 are inserted into the anchor holes 58 to rigidly connect the stringer sections 50. The stringers, when rigidly connected, provide structural support for the vehicle when the pontoons are in the laterally extended position.

What is claimed is:

1. An amphibious vehicle for forming a section of a floating bridge, comprising (a) a vehicle body member including a horizontal bottom wall, and generally vertical front and rear end walls;

(b) a pontoon member initially arranged laterally adjacent one side of said vehicle body member, said pontoon member including a bottom wall, a pair of end walls, and a side wall connected between said end walls, whereby said pontoon member is open at one side; and (c) means pivotally connecting the bottom portion of said pontoon member adjacent its open side with said vehicle body member adjacent the bottom thereof for pivotal movement about a horizontal longitudinally extending pivot axis, said pontoon member being pivotally displaceable from its initial laterally extended position to a retracted transport position relative to said vehicle body member, respectively, said pontoon member, when in the retracted transport position, being substantially contained between the front and rear end walls of said vehicle body member.

2. An amphibious vehicle as defined in claim 1, wherein said vehicle body member includes a pair of opposed generally vertical side walls, said pontoon member being pivotally connected within an opening contained in one of said side walls.

3. Apparatus as defined in claim 1, and further including horizontal seal means for sealing the pivot connection between the body member and the bottom portion of the pontoon member.

4. Apparatus as defined in claim 2, wherein said opening includes a horizontal bottom edge adjacent said pivot means, and a pair of vertical edges located adjacent said pontoon member end walls, respectively, and further including vertical compressible seal means for sealing the space between said opening vertical edges and said pontoon member end walls, respectively.

5. Apparatus as defined in claim 4, and further including locking pin means for compressing the seal means between said vertical edges and said end walls, respectively.

6. An amphibious vehicle as defined in claim 1, and further including at least one elongated horizontally arranged reinforcing stringer for structurally strengthening said vehicle when said pontoon means is in the laterally extending position, said stringer further including means for forming gaps in said stringer to allow movement of said pontoon member end portions from said laterally extended to said retracted transport position, whereby said end portions pass through said gaps in said retracted transport position.

7. An amphibious vehicle as defined in claim 6, and further including a horizontal deck supported by said stringer.

8. An amphibious vehicle as defined in claim 6, and further including longitudinally extendible ramps connected with said vehicle body member end walls.

* * * * *